US008931136B2

(12) United States Patent
Mantell et al.

(10) Patent No.: US 8,931,136 B2
(45) Date of Patent: Jan. 13, 2015

(54) CANISTER VACUUM CLEANER

(71) Applicant: Dyson Technology Limited, Wiltshire (GB)

(72) Inventors: Howard Dennington Mantell, Malmesbury (GB); Giles Ashbee, Malmesbury (GB); Paul Jason Eardley, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/055,197

(22) Filed: Oct. 16, 2013

(65) Prior Publication Data

US 2014/0101888 A1 Apr. 17, 2014

(30) Foreign Application Priority Data

Oct. 17, 2012 (GB) ..... 1218677.1

(51) Int. Cl.

| | |
|---|---|
| ***A47L 5/36*** | (2006.01) |
| ***A47L 9/10*** | (2006.01) |
| ***A47L 9/24*** | (2006.01) |
| *A47L 9/16* | (2006.01) |

(52) U.S. Cl.

CPC ..... *A47L 5/362* (2013.01); *A47L 9/102* (2013.01); *A47L 9/242* (2013.01); *A47L 5/36* (2013.01); *A47L 9/1691* (2013.01); *A47L 9/165* (2013.01)

USPC ..... 15/327.1; 15/327.2; 15/353

(58) Field of Classification Search

CPC ..... A47L 5/36; A47L 9/1691
USPC ..... 15/327.1, 327.2, 327.6, 327.7, 353
IPC ..... A47L 5/36
See application file for complete search history.

(56) References Cited

U.S. PATENT DOCUMENTS

| | | | | |
|---|---|---|---|---|
| 8,434,193 | B2 * | 5/2013 | Sunderland et al. | 15/353 |
| 8,516,652 | B2 * | 8/2013 | Sunderland et al. | 15/327.4 |
| 2003/0200622 | A1 | 10/2003 | Park et al. | |
| 2004/0139573 | A1 | 7/2004 | Stephens et al. | |
| 2006/0230721 | A1 | 10/2006 | Oh et al. | |
| 2007/0079473 | A1 | 4/2007 | Min et al. | |
| 2007/0084160 | A1 | 4/2007 | Kim | |
| 2007/0214754 | A1 | 9/2007 | Kim | |
| 2014/0047667 | A1 | 2/2014 | Robertson et al. | |

(Continued)

FOREIGN PATENT DOCUMENTS

| | | |
|---|---|---|
| EP | 1 676 517 | 7/2006 |
| EP | 1 726 245 | 11/2006 |

(Continued)

OTHER PUBLICATIONS

Search Report dated Jan. 30, 2013, directed to GB Application No. 1218677.1; 1 page.

*Primary Examiner* — David Redding
(74) *Attorney, Agent, or Firm* — Morrison & Foerster LLP

(57) ABSTRACT

A canister vacuum cleaner that includes a main body to which a hose is attached. The main body includes a chassis, a dirt separator carried by the chassis, and an inlet assembly for carrying fluid from the hose to the dirt separator. The dirt separator includes an inlet located in a base of the dirt separator. The inlet assembly includes a spigot fixed to the chassis and a hose coupling rotatably attached to the spigot. The hose is then attached to the hose coupling, and the spigot projects into the inlet such that the spigot both supports and carries fluid to the dirt separator.

13 Claims, 5 Drawing Sheets

(56) References Cited

U.S. PATENT DOCUMENTS

| | | | |
|---|---|---|---|
| 2014/0047668 | A1 | 2/2014 | Dyson et al. |
| 2014/0053365 | A1 | 2/2014 | Gammack et al. |
| 2014/0053368 | A1 | 2/2014 | Gammack et al. |

FOREIGN PATENT DOCUMENTS

| | | |
|---|---|---|
| EP | 1 772 091 | 4/2007 |
| EP | 1 774 890 | 4/2007 |
| EP | 1 952 744 | 8/2008 |
| EP | 1 961 356 | 8/2008 |
| GB | 2 255 296 | 11/1992 |
| GB | 2 450 736 | 1/2009 |
| GB | 2 453 760 | 4/2009 |
| GB | 2469045 | 10/2010 |
| GB | 2469057 | 10/2010 |
| GB | 2487398 | 7/2012 |
| WO | WO-2010/044541 | 4/2010 |

* cited by examiner

CANISTER VACUUM CLEANER

REFERENCE TO RELATED APPLICATION

This application claims the priority of United Kingdom Application No. 1218677.1 filed Oct. 17, 2012, the entire contents of which are incorporated herein by reference.

FIELD OF THE INVENTION

The present invention relates to a canister vacuum cleaner.

BACKGROUND OF THE INVENTION

Canister vacuum cleaners typically have a dirt separator that is removably mounted to a chassis. The chassis generally comprises supports for holding the dirt separator, as well as ducting for carrying fluid to and from the dirt separator. Together the supports and ducting impact on the overall size of the vacuum cleaner.

SUMMARY OF THE INVENTION

The present invention provides a canister vacuum cleaner comprising a main body to which a hose is attached, the main body comprising a chassis, a dirt separator carried by the chassis, and an inlet assembly for carrying fluid from the hose to the dirt separator, wherein the dirt separator comprises an inlet located in a base of the dirt separator, the inlet assembly comprises a spigot fixed to the chassis and a hose coupling rotatably attached to the spigot, the hose is attached to the hose coupling, and the spigot projects into the inlet such that the spigot both supports and carries fluid to the dirt separator.

Since the spigot both supports the dirt separator and carries fluid to the dirt separator, a more compact vacuum cleaner may be realised. Additionally, by locating the inlet in the base of the dirt separator, a less tortuous path may be taken by the fluid carried to the dirt separator. The dirt separator is intended to be removable from the chassis. The spigot then provides a convenient means for locating the dirt separator on the chassis.

By having a hose coupling that is rotatably attached to the spigot, the hose is permitted to rotate or swivel relative to the main body. During use of the vacuum cleaner, the hose is often pulled in different directions relative to the main body. If the hose were fixed relative to the main body, pulling the hose in different directions may generate considerable stress at the attachment with the main body. Over time the stress may weaken and tear the hose. By providing a hose coupling that permits swivelling of the hose relative to the main body, less stress is placed on the hose and thus the longevity of the hose is increased. Additionally, since the hose is free to swivel relative to the main body, the main body is not constantly being pulled in different directions by the hose. As a result, a more stable vacuum cleaner is achieved.

The spigot may be located at a front of the chassis and extend along an axis about which the hose coupling rotates. The hose coupling then comprises an elbow such that the hose swivels to the left and right as the hose coupling rotates relative to the spigot. By locating the spigot at the front of the chassis, manoeuvring the main body using the hose is made easier. In particular, the main body can be pulled forwards using the hose. Since the hose is attached to the front of the main body, the hose will typically be pulled to the left and right during use. By having an elbow in the hose coupling, the hose is free to swivel to the left and right. As a result, less stress is placed on the hose and the stability of the vacuum cleaner is improved.

The spigot may be located at a front of the chassis and extend along an axis that is tilted relative to vertical when the vacuum cleaner rests on a horizontal surface, the tilt occurring in a direction towards the rear of the chassis. The inlet to the dirt separator is located in the base. The hose, however, ideally extends from the front of the main body so that the hose may be used to manoeuvre the main body. As a result, an elbow is required in the inlet assembly. Any elbow is likely to affect the performance of the vacuum cleaner since the fluid is then required to make a relatively sharp turn. By having a spigot that is tilted towards the rear of the chassis, a smaller elbow is required and thus the performance of the vacuum cleaner may be improved.

The end of the hose coupling to which the hose is attached may extend along an axis that is inclined upwardly relative to horizontal when the vacuum cleaner rests on a horizontal surface. During use, the hose generally extends between the main body and a handle held by a user. Owing to the difference in height between the two ends of the hose, the hose exerts at upward force at the front of the main body whenever the user pulls at the hose. This upward force causes the front of the main body to lift from the cleaning surface. If the hose were to extend from the main body in a horizontal direction, the resulting lift may cause the main body to become unstable and topple. By having a hose coupling that extends along an axis that is inclined relative to the horizontal, the hose extends from the main body in a direction that is tilted upwardly. As a result, the main body lifts by a smaller amount and thus a more stable vacuum cleaner is obtained.

The hose may be rotatable attached to the hose coupling. As a result, the hose is free to rotate relative to the main body about its longitudinal axis. This then has the benefit that the attachment of the hose to the main body is subjected to less mechanical stress. Additionally, the stability of the vacuum cleaner is improved. In contrast, if the hose were fixed relative to the main body, rotation of the hose about its axis would generate stress at the attachment with the main body. Additionally, the hose would exert a torque on the main body that would adversely affect the stability of the main body. In particular, when the main body is pulled over an uneven surface or is pulled to the left or right, the torque exerted by the hose may cause the main body to topple over.

The inlet assembly may comprise a barrel-shaped roller attached to the hose coupling. The roller supports the hose coupling above the cleaning surface. Additionally, the roller aids in manoeuvring the vacuum cleaner. In particular, as the hose coupling rotates relative to the spigot, the roller swivels relative to the chassis and thus the direction of travel of the roller changes. Pulling the hose then causes the chassis to turn and follow the movement of the roller. The hose coupling may rotate relative to the spigot about an axis that is tilted relative to the vertical. Consequently, as the hose coupling rotates, the roller swivels in an arc relative to the horizontal. By having a barrel-shaped roller, the hose coupling is supported above the cleaning surface at the same height irrespective of the swivel position of the roller. In contrast, if the roller were cylindrical, the hose coupling and thus the front of the chassis would be lifted as the roller swivels left and right. This is then likely to make swivelling of the roller difficult.

The spigot may support the base of the dirt separator above the chassis, i.e. the base of the dirt separator may be clear of the chassis. The dirt separator is then better isolated from the chassis. As a result, less vibration is transmitted from the chassis to the dirt separator.

The present invention further provides a canister vacuum cleaner comprising a main body to which a hose is attached, the main body comprising a chassis, a dirt separator carried by the chassis, and an inlet assembly for carrying fluid from the hose to the dirt separator, wherein the dirt separator comprises an inlet located in a base of the dirt separator, the inlet assembly comprises a spigot fixed to the chassis and a hose coupling rotatably attached to the spigot, the spigot projects into the inlet of the dirt separator and extends along an axis about which the hose coupling rotates, the hose is attached to the hose coupling, and the hose coupling comprises an elbow such that the hose swivels to the left and right as the hose coupling rotates relative to the spigot.

By having a hose coupling that is rotatably attached to the spigot, the hose is permitted to rotate or swivel relative to the main body. During use of the vacuum cleaner, the hose is often pulled in different directions relative to the main body. If the hose were fixed relative to the main body, pulling the hose in different directions may generate considerable stress at the attachment with the main body. Over time the stress may weaken and tear the hose. By providing a hose coupling that permits swivelling of the hose relative to the main body, less stress is placed on the hose and thus the longevity of the hose is increased. Additionally, since the hose is free to swivel relative to the main body, the main body is not constantly being pulled in different directions by the hose. As a result, a more stable vacuum cleaner is achieved. By having an elbow in the hose coupling, less stress is placed on the hose as it pulled left and right, and the stability of the vacuum cleaner is improved.

The spigot may be located at a front of the chassis and extend along an axis that is tilted relative to vertical when the vacuum cleaner rests on a horizontal surface, the tilt occurring in a direction towards the rear of the chassis. The elbow in the hose coupling may affect the performance of the vacuum cleaner since the fluid is required to make a relatively sharp turn. However, by having a spigot that is tilted towards the rear of the chassis, a smaller elbow is required and thus the performance of the vacuum cleaner may be improved.

The end of the hose coupling to which the hose is attached may extend along an axis that is inclined upwardly relative to horizontal when the vacuum cleaner rests on a horizontal surface. During use, the hose generally extends between the main body and a handle held by a user. Owing to the difference in height between the two ends of the hose, the hose exerts at upward force at the front of the main body whenever the user pulls at the hose. This upward force causes the front of the main body to lift from the cleaning surface. If the hose were to extend from the main body in a horizontal direction, the resulting lift may cause the main body to become unstable and topple. By having a hose coupling that extends along an axis that is inclined relative to the horizontal, the hose extends from the main body in a direction that is tilted upwardly. As a result, the main body lifts by a smaller amount and thus a more stable vacuum cleaner is obtained.

The hose may be rotatable attached to the hose coupling. As a result, the hose is free to rotate relative to the main body about its longitudinal axis. This then has the benefit that the attachment of the hose to the main body is subjected to less mechanical stress. Additionally, the stability of the vacuum cleaner is improved. In contrast, if the hose were fixed relative to the main body, rotation of the hose about its axis would generate stress at the attachment with the main body. Additionally, the hose would exert a torque on the main body that would adversely affect the stability of the main body. In particular, when the main body is pulled over an uneven surface or is pulled to the left or right, the torque exerted by the hose may cause the main body to topple over.

The inlet assembly may comprise a barrel-shaped roller attached to the hose coupling. The roller supports the hose coupling above the cleaning surface. Additionally, the roller aids in manoeuvring the vacuum cleaner. In particular, as the hose coupling rotates relative to the spigot, the roller swivels relative to the chassis and thus the direction of travel of the roller changes. Pulling the hose then causes the chassis to turn and follow the movement of the roller. The hose coupling may rotate relative to the spigot about an axis that is tilted relative to the vertical. Consequently, as the hose coupling rotates, the roller swivels in an arc relative to the horizontal. By having a barrel-shaped roller, the hose coupling is supported above the cleaning surface at the same height irrespective of the swivel position of the roller. In contrast, if the roller were cylindrical, the hose coupling and thus the front of the chassis would be lifted as the roller swivels left and right. This is then likely to make swivelling of the roller difficult.

The spigot may support the base of the dirt separator above the chassis, i.e. the base of the dirt separator may be clear of the chassis. The dirt separator is then better isolated from the chassis. As a result, less vibration is transmitted from the chassis to the dirt separator.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
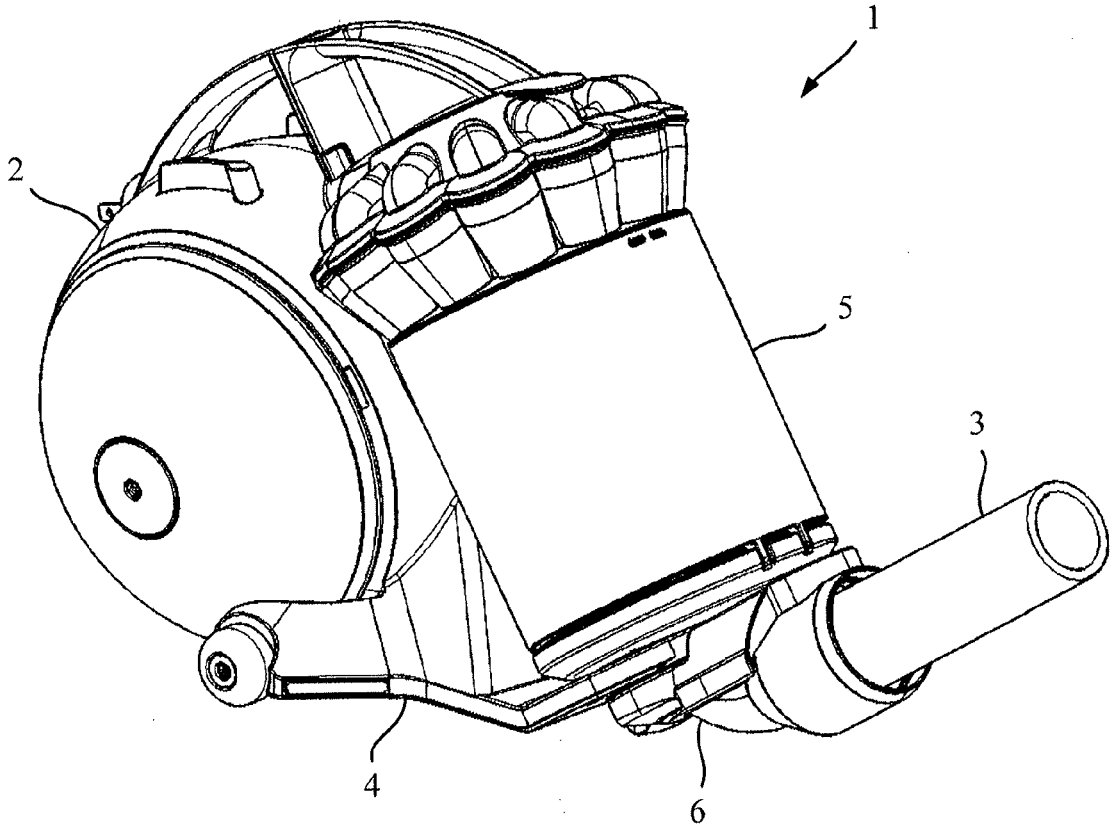
FIG. 1 is a front axonometric view of a vacuum cleaner in accordance with the present invention.
Figure 2:
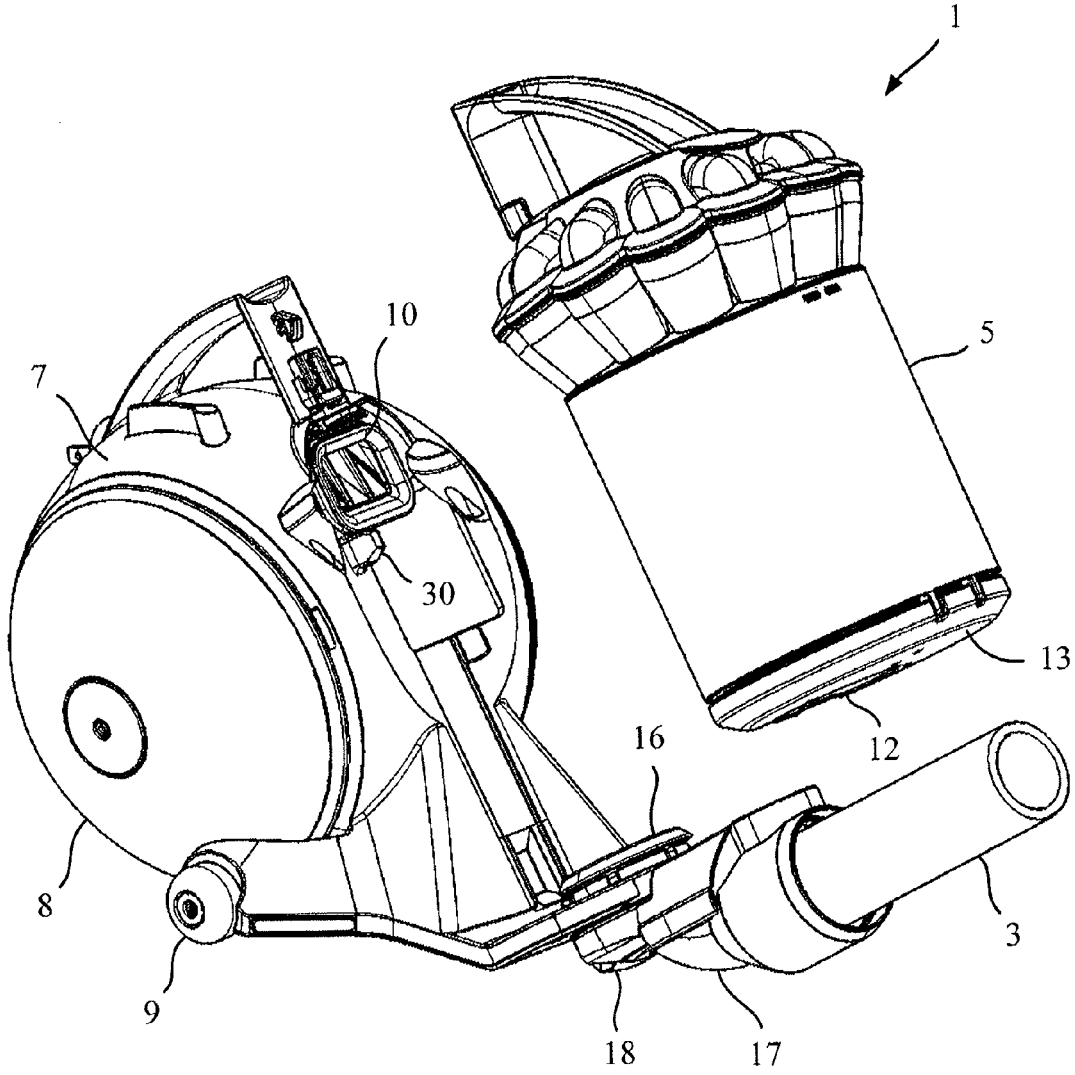
FIG. 2 is a front axonometric view of the vacuum cleaner in which the dirt separator is separated from the chassis.
Figure 3:
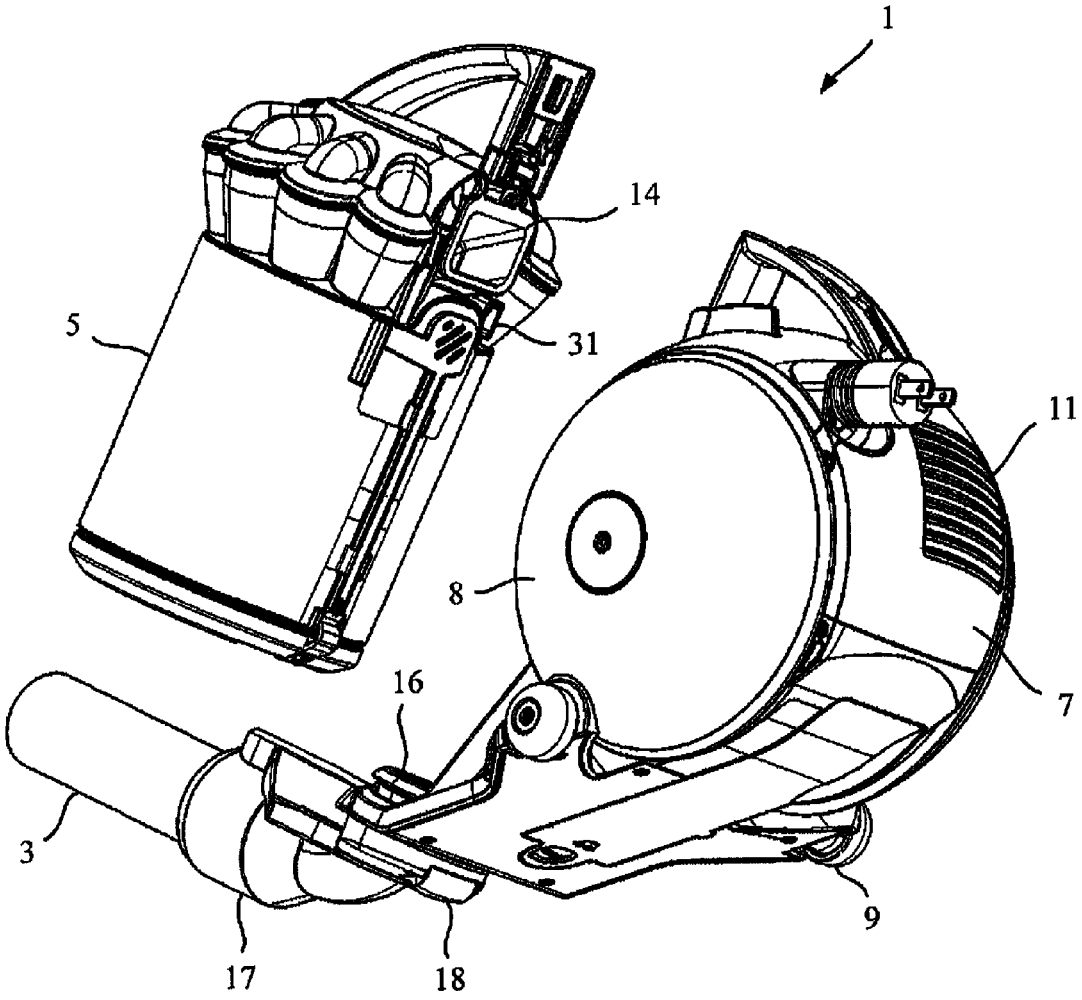
FIG. 3 is a rear axonometric view of the vacuum cleaner in which the dirt separator is separated from the chassis.
Figure 4:
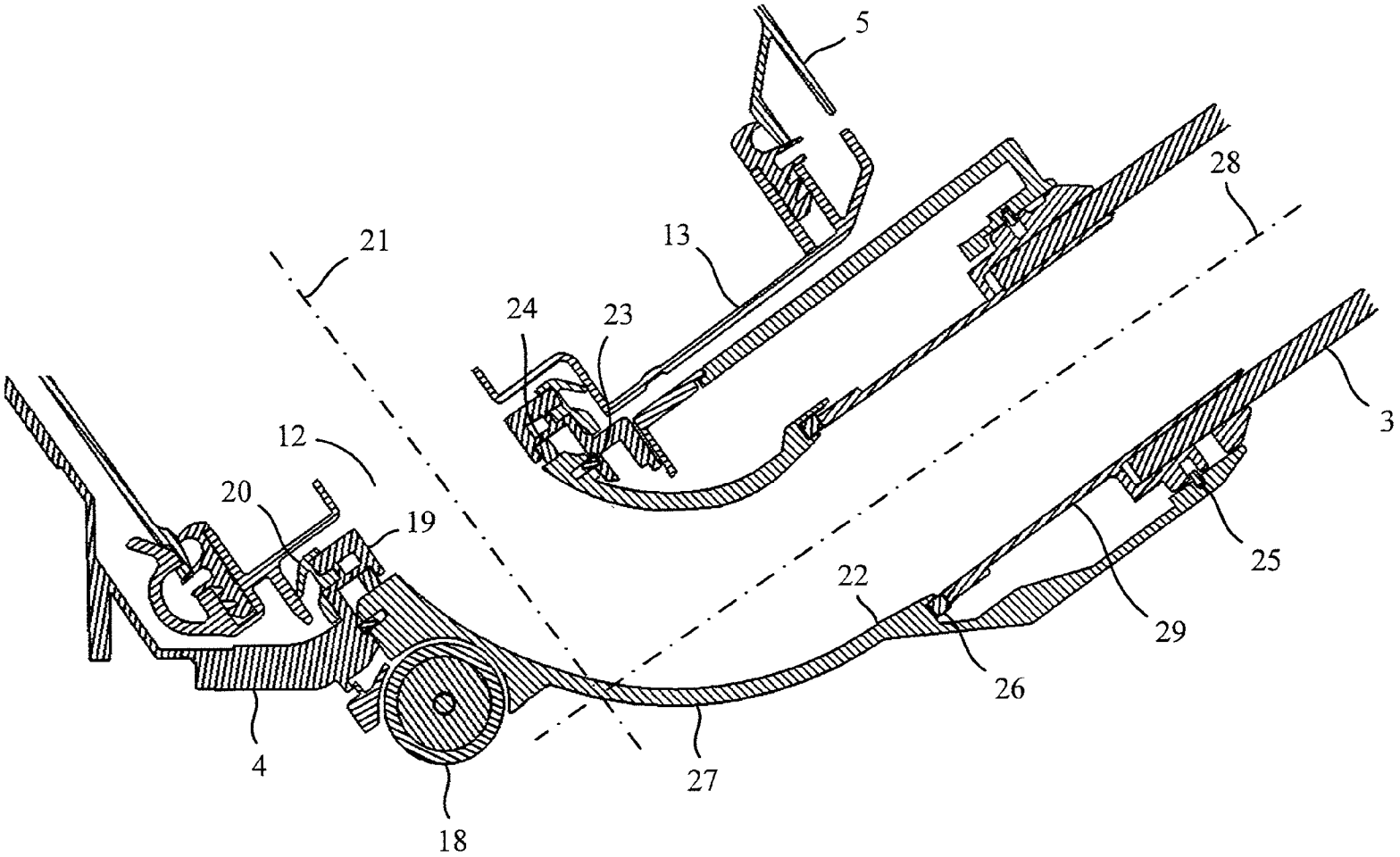
FIG. 4 is a sectional slice through the inlet assembly of the vacuum cleaner.
Figure 5:
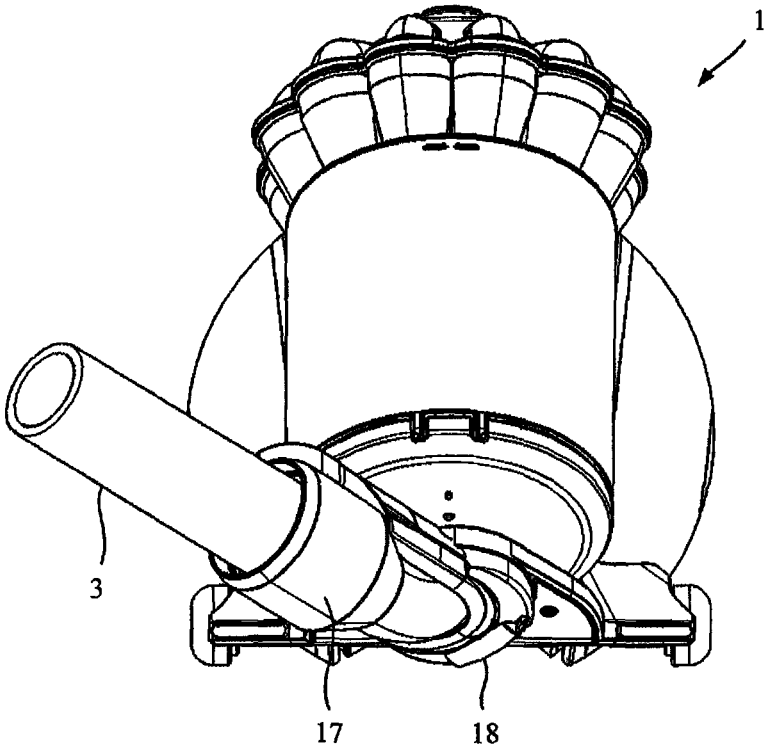
FIG. 5 is a front elevation of the vacuum cleaner in which the hose is swivelled to one side.

The vacuum cleaner 1 of FIGS. 1 to 5 is of a canister type and comprises a main body 2 to which a hose 3 is attached.

The main body 2 comprises a chassis 4, a dirt separator 5 carried by the chassis 4, and an inlet assembly 6 for carrying fluid from the hose 3 to the dirt separator 5.

The chassis 4 comprises a housing unit 7, a pair of primary wheels 8, and a pair of secondary wheels 9.

The housing unit 7 houses, among other things, a suction source and ducting for carrying fluid from an inlet 10 to the suction source, and from the suction source to an outlet 11.

The primary wheels 8 are secured to opposite sides of the housing unit 7. The secondary wheels 9 are much smaller than the primary wheels 8 and act as stabilisers. When the chassis 4 is level with the cleaning surface, the primary wheels 8 and the secondary wheels 9 provide rolling support for the chassis 4. However, as explained below, during use the chassis 4 is often lifted at the front and pulled forwards. In this instance, the secondary wheels 9 are lifted from the cleaning surface and rolling support is provided by the primary wheels 8 only. Should the main body 2 inadvertently tip to the left or right, the secondary wheels 9 contact the cleaning surface and prevent the main body 2 from toppling over.

The dirt separator 5 comprises an inlet 12 located in a base 13 of the dirt separator 5, and an outlet 14 located in a side of the dirt separator 5. When carried by the chassis 4, the outlet 14 of the dirt separator 5 engages with and forms a seal with the inlet 10 of the housing unit 7. The suction generated by the suction source causes fluid to be drawn into the dirt separator 5 via the inlet 12. Dirt is then separated from the fluid and retained by the dirt separator 5. The cleansed fluid is drawn out of the dirt separator 5 via the outlet 14, whereupon it is carried to the outlet 11 in the housing unit 7 and exhausted from the vacuum cleaner 1.

The inlet assembly 6 is located at a front the chassis 4 and comprises a spigot 16, a hose coupling 17, and a roller 18.

The spigot 16 is fixed to and is upstanding from the chassis 4. The spigot 16 comprises a first duct 19 and a seal 20 provided around an upper end of the first duct 19. In this particular embodiment, the first duct 19 is formed integrally with the chassis 4. This then has the benefit of simplifying the manufacture and assembly of the vacuum cleaner 1. The spigot 16 extends along an axis 21 that is tilted relative to the vertical. That is to say that, when the chassis 4 rests on a horizontal surface, the spigot 16 is tilted from vertical. More specifically, the spigot 16 extends along an axis 21 that is tilted rearwards. Consequently, the spigot 16 extends upwardly from the chassis 4 in a direction towards the rear of the chassis 4.

The hose coupling 17 is rotatably attached to the spigot 16 at one end, and rotatably attached to the hose 3 at the opposite end. The hose coupling 17 comprises a second duct 22 that extends between the spigot 16 and the hose 3. The second duct 22 is rotatably attached at one end to the first duct 19. Rotatable attachment is achieved by means of a snap-ring 23 seated within annular grooves in the two ducts 19, 22. In order to minimise leaks between the two ducts 19, 22, a gasket 24 is provided between the end of the second duct 22 and a shoulder in the first duct 19. The second duct 22 is rotatably attached at an opposite end to the hose 3. The hose 3 comprises a cuff 29 at one end. The second duct 22 is then rotatably attached to the cuff 29. Again, rotatable attachment is achieved by means of a snap-ring 25 seated within grooves in the cuff 29 and the second duct 22, and a gasket 26 is provided between an end of the cuff 29 and a shoulder in the second duct 22 in order to minimise leaks. Between the spigot 16 and the hose 3 the second duct 22 comprises a bend or elbow 27 that turns through approximately 90 degrees. As a result, the end of the hose coupling 17 to which the hose 3 is attached extends along an axis 28 that is inclined upwardly relative to the horizontal. That is to say that, when the chassis 4 rests on a horizontal surface, the end of the hose coupling 17 inclines upwardly relative to the surface.

The hose coupling 17 may be said to rotate relative to the spigot 16 about a first axis 21, and the hose 3 may be said to rotate relative to the coupling 17 about a second axis 28. Owing to the elbow 27 in the hose coupling 17, the angle between the two axes 21, 28 is approximately 90 degrees. The first axis 21 is coincident with the axis along which the spigot 16 extends. Consequently, the first axis 21 is tilted relative to the vertical. The second axis 28 is coincident with the axis along which the end of the hose coupling 17 extends. Consequently, the second axis 28 is inclined upwards relative to the horizontal.

The roller 18 is barrel shaped and is mounted to the bottom of the hose coupling 17. The roller 18 acts to support the hose coupling 17 above the cleaning surface. Additionally, as explained below, the roller 18 helps to manoeuvre the vacuum cleaner 1 in different directions.

The hose 3 comprises a cuff 29 at one end to which the hose coupling 17 is attached. The opposite end of the hose 3 is typically attached to a handle of a wand, which in turn is attached to a cleaner head.

The dirt separator 5 is removably carried by the chassis 4. When carried by the chassis 4, the spigot 16 projects into and forms a seal against the inlet 12 in the base 13 of the dirt separator 5. The spigot 16 therefore acts to both support and carry fluid to the dirt separator 5. Consequently, in contrast to vacuum cleaners having separate supports and ducting, a more compact and cheaper vacuum cleaner 1 may be realised.

In supporting the dirt separator 5, the spigot 16 prevents movement of the dirt separator 5 in directions along and normal to the axis 21 of the spigot 16. Indeed, when the dirt separator 5 is mounted to the spigot 16, the chassis 4 need only prevent movement of the dirt separator 5 in a direction upward along the axis 21 of the spigot 16. In the present embodiment, movement in an upward direction is prevented by means of a projection 30 provided on the chassis 4, which engages with a recess 31 provided in the dirt separator 5. If the base 13 of the dirt separator 5 were supported by the chassis 4, tighter tolerancing would be required in order to ensure that the projection 30 fits within the recess 31. Supporting the dirt separator 5 on the spigot 16 has the advantage that the seal 20 provides a degree of resilience. As a result, the tolerancing need not be as tight. The spigot 16 has the further advantage that, when returning the dirt separator 5 to the chassis 4, the spigot 16 provides a convenient means for locating the dirt separator 5 on the chassis 4.

The spigot 16 supports the base 13 of the dirt separator 5 above the chassis 4, i.e. the base 13 of the dirt separator 5 is clear of the chassis 4. This then has the benefit that the dirt separator 5 is better isolated from the chassis 4 and thus less vibration (typically generated by the suction source) is transmitted from the chassis 4 to the dirt separator 5.

By locating the inlet 12 in the base 13 of the dirt separator 5, a less tortuous path (in comparison to some other vacuum cleaners) is taken by the fluid when travelling from the hose 3 to the dirt separator 5. As a result, an increase in performance (e.g. airwatts) may be obtained.

It may be necessary or desirable to carry the dirt separator 5 in a relatively upright position. For example, dirt separated by the dirt separator 5 may collect at the base 13 of the dirt separator 5. Since the inlet 12 is located in the base 13 of the dirt separator 5, an elbow 27 is required in the inlet assembly 6. Any elbow is likely to affect the performance of the vacuum cleaner 1 since fluid is then required to make a relatively sharp turn. However, by having a spigot 16 that is tilted towards the rear of the chassis 4, the base 13 of the dirt separator 5 is directed towards the front of the chassis 4. As a result, a smaller elbow 27 may be employed and thus the performance of the vacuum cleaner 1 may be improved.

The main body 2 is generally manoeuvred over a cleaning surface by pulling the hose 3. Since the inlet assembly 6 is located at the front of the chassis 4, the hose 3 attaches to the front of the main body 2. Pulling the hose 3 therefore causes the main body 2 to move forwards. In addition to pulling the hose 3 forwards, a user will typically pull the hose 3 to the left and right in order to clean different areas of the cleaning surface. If the hose 3 were fixed to the main body 2, pulling the hose 3 to the left and right would place considerable stress on the hose 3 at the attachment with the main body 2. Over time, this stress may weaken and tear the hose 3. The hose coupling 17, however, is rotatably attached to the spigot 16. As a result, the hose coupling 17 is free to swivel relative to the chassis 4, and thus the hose 3 is free to swivel left and right relative to the main body 2 (see, for example, FIG. 5). The hose 3 is therefore subjected to less stress and thus the longevity of the hose 3 is improved. In addition, if the hose 3 were fixed to the main body 2, pulling the hose 3 to the left and right is likely to cause the main body 2 to turn. Constantly turning the main body 2 to the left and right in order to clean different areas may prove frustrating and/or tiring for the user. Additionally, it may be desirable to minimise movement of the main body 2 on certain types of cleaning surface. For example, movement of the main body 2 on a hard surface may prove noisy and may potentially mark the surface. Since the hose 3 is free to swivel relative to the main body 2, areas to the left and right of the main body 2 may be cleaned without necessarily moving the main body 2.

The hose 3 may also twist or rotate about its longitudinal axis during use. Again, if the hose 3 were fixed to the main body 2, this twisting would stress the hose 3 at the attachment with the main body 2. Additionally, the hose 3 would exert a torque on the main body 2 that would adversely affect the stability the main body 2. In particular, as the main body 2 is pulled over an uneven surface or is pulled to the left or right, the torque exerted by the hose 3 may cause the main body 2 to topple over. In having a hose 3 that is rotatable attached to the hose coupling 17, the hose 3 is free to rotate about its longitudinal axis. As a result, the attachment between the hose 3 and the hose coupling 17 is subjected to less mechanical stress and the stability of the vacuum cleaner 1 is improved.

The hose 3 typically extends between the main body 2 and a handle held by a user. Owing to the difference in height between the two ends of the hose 3, the hose 3 exerts an upward force at the front of the main body 2 whenever the user pulls at the hose 3. This upward force causes the front of the main body 2 to lift from the cleaning surface. The primary wheels 8 continue to contact the cleaning surface to provide a rolling support. The secondary wheels 9, on the other hand, are lifted off the cleaning surface. If the main body 2 is lifted by an excessive amount, the main body 2 may become unstable and topple over. In particular, the secondary wheels 9 may be lifted to a height at which they are no longer able to prevent the main body 2 from toppling over. By employing a hose coupling 17 that extends along an axis 28 that is inclined relative to the horizontal, the hose 3 extends from the main body 2 in a direction that is inclined upwardly. As a result, the main body 2 lifts by a smaller amount and thus a more stable vacuum cleaner 1 is obtained.

As the main body 2 moves over the cleaning surface, the roller 18 provides a rolling support for the hose coupling 17. However, the roller 18 additionally aids in manoeuvring the main body 2 to the left and right. When the hose coupling 17 swivels to the left or right, the roller 18 also swivels to the left or right. As a result, the direction of travel of the roller 18 points to the left or right (see, for example, FIG. 5). Pulling the hose 3 forwards then causes the front part of the chassis 4 to follow the direction of travel of the roller 18. As a result, the chassis 4 turns to the left or right.

The hose coupling 17 rotates about an axis 21 that is tilted relative to the vertical. As a result, the end of the hose coupling 17 that attaches to the hose 3 swivels in an arc relative to the horizontal plane. The roller 18, being attached to the hose coupling 17, therefore swivels in an arc relative to the horizontal plane. By having a barrel-shaped roller 18, the roller 18 supports the hose coupling 17 above the cleaning surface at the same height irrespective of the position of the roller 18. In contrast, if the roller 18 were cylindrical, the hose coupling 17 and thus the front of the chassis 4 would lift as the roller 18 swivels to the left and right. This would then make swivelling of the roller 18, and thus manoeuvring of the main body 2, more difficult.

The invention claimed is:

1. A canister vacuum cleaner comprising a main body to which a hose is attached, the main body comprising a chassis, a dirt separator carried by the chassis, and an inlet assembly for carrying fluid from the hose to the dirt separator, wherein the dirt separator comprises an inlet located in a base of the dirt separator, the inlet assembly comprises a spigot fixed to the chassis and a hose coupling rotatably attached to the spigot, the hose is attached to the hose coupling, and the spigot projects into the inlet such that the spigot both supports and carries fluid to the dirt separator.

2. The vacuum cleaner of claim 1, wherein the spigot is located at a front of the chassis and extends along an axis about which the hose coupling rotates, and the hose coupling comprises an elbow such that the hose swivels to the left and right as the hose coupling rotates relative to the spigot.

3. The vacuum cleaner of claim 1, wherein the spigot is located at a front of the chassis and extends along an axis that is tilted relative to vertical when the vacuum cleaner rests on a horizontal surface, the tilt occurring in a direction towards the rear of the chassis.

4. The vacuum cleaner of claim 1, wherein the end of the hose coupling to which the hose is attached extends along an axis that is inclined upwardly relative to horizontal when the vacuum cleaner rests on a horizontal surface.

5. The vacuum cleaner of claim 1, wherein the hose is rotatable attached to the hose coupling.

6. The vacuum cleaner of claim 1, wherein the inlet assembly comprises a barrel-shaped roller attached to the hose coupling.

7. The vacuum cleaner of claim 1, wherein the spigot supports the base of the dirt separator above the chassis.

8. A canister vacuum cleaner comprising a main body to which a hose is attached, the main body comprising a chassis, a dirt separator carried by the chassis, and an inlet assembly for carrying fluid from the hose to the dirt separator, wherein the dirt separator comprises an inlet located in a base of the dirt separator, the inlet assembly comprises a spigot fixed to the chassis and a hose coupling rotatably attached to the spigot, the spigot projects into the inlet of the dirt separator and extends along an axis about which the hose coupling rotates, the hose is attached to the hose coupling, and the hose coupling comprises an elbow such that the hose swivels to the left and right as the hose coupling rotates relative to the spigot.

9. The vacuum cleaner of claim 8, wherein the spigot is located at a front of the chassis and extends along an axis that is tilted relative to vertical when the vacuum cleaner rests on a horizontal surface, the tilt occurring in a direction towards the rear of the chassis.

10. The vacuum cleaner of claim 8, wherein the end of the hose coupling to which the hose is attached extends along an axis that is inclined upwardly relative to horizontal when the vacuum cleaner rests on a horizontal surface.

11. The vacuum cleaner of claim 8, wherein the hose is rotatable attached to the hose coupling.

12. The vacuum cleaner of claim 8, wherein the inlet assembly comprises a barrel-shaped roller attached to the hose coupling.

13. The vacuum cleaner of claim 8, wherein the spigot supports the base of the dirt separator above the chassis.

* * * * *